US005766837A

United States Patent [19]

Ozeki et al.

[11] Patent Number: 5,766,837

[45] Date of Patent: Jun. 16, 1998

[54] SILVER HALIDE PHOTOGRAPHIC MATERIAL AND METHOD FOR PRODUCING THE SAME

[75] Inventors: Tomoyuki Ozeki; Seiji Yamashita; Yuji Yoshida, all of Kanagawa, Japan

[73] Assignee: Fuji Photo Film Co., Ltd., Kanagawa, Japan

[21] Appl. No.: 503,506

[22] Filed: Jul. 18, 1995

[30] Foreign Application Priority Data

Jul. 20, 1994 [JP] Japan ..... 6-167798

[51] Int. Cl.[6] ..... G03C 1/005

[52] U.S. Cl. ..... 430/567; 430/603; 430/605

[58] Field of Search ..... 430/567, 603, 430/605

[56] References Cited

U.S. PATENT DOCUMENTS 3,442,653 5/1969 Dunn ..... 430/605

4,897,343 1/1990 Ikeda et al. ..... 430/603

5,252,448 10/1993 Nishio et al. ..... 430/523

OTHER PUBLICATIONS

Dupain-Klerkx, L. and Faelens, P., *J. Photographic Science*, 35(4), 136 (1987).

*Primary Examiner*—Janet C. Baxter

*Attorney, Agent, or Firm*—Sughrue, Mion, Zinn, Macpeak & Seas, PLLC

[57] ABSTRACT

A silver halide photographic material comprising a support having thereon at least one silver halide emulsion layer containing silver halide grains, wherein the silver halide grains has been gold and chalcogen sensitized, and the partition rate of the gold in the silver halide grain side is not less than 10% and less than 40%, and a method for producing the silver halide photographic material.

12 Claims, No Drawings

SILVER HALIDE PHOTOGRAPHIC MATERIAL AND METHOD FOR PRODUCING THE SAME

FIELD OF THE INVENTION

The present invention relates to a silver halide photographic material and the method for producing the same and, particularly, relates to producing a photographic material comprising a silver halide emulsion which is high sensitive, rapid in development progress, excellent in storage stability and processability, and easy to handle.

BACKGROUND OF THE INVENTION

Various performances are required of the photographic material in recent years, in particular, the improvement of sensitivity and storage stability is always required of the photographic materials for photographing and printing.

On the other hand, the simplification and speedup of the development processing have been increasingly required and the reduction of the replenishment of the replenisher is also demanded. However, the improvement of sensitivity and storage stability of the photographic material and the reduction of the replenisher and speedup of the processing are often incompatible. For example, the representative and best-known technique of increasing sensitivity is to increase the iodide content of a silver halide emulsion and this is disclosed in various literature and patents.

Examples of increasing sensitivity by iodide are disclosed, for example, in JP-A-48-51627, JP-A-2-193137 and JP-A-3-1211442 (the term "JP-A" as used herein refers to a "published unexamined Japanese patent application").

The use of silver iodide on the surface of a silver halide grain not only heightens the adsorption of a spectral sensitizing dye and increases sensitivity but also prevent the desorption of a dye under high temperature and high humidity conditions and improves the storage stability. That is, the adsorption of a dye is heightened by the halide conversion by iodide on the surface of a grain, and the formation site of the chemical sensitization speck is controlled by the site direct function of a dye, and this is a well known technique in the art as disclosed in JP-A-63-305343 and JP-A-3-121442.

However, such a usage of silver iodide brings about not only the deterioration of the pressurability (pressure blackening), but also fog, fixing failure and remaining color of a dye due to the accumulation of the iodine ion in the processing solution, therefore, this is not desirable from the point of rapid processing and the reduced replenishing resistance.

Thus, the harmful influences of increasing the content of silver iodide in silver halide with respect to processing solutions and the like are disclosed in detail, for example, in JP-A-2-225637, JP-A-3-121789, JP-A-3-135227 and JP-A-3-103639.

On the other hand, the increase of the developing agent and the auxiliary developing agent in a developing solution and raising the pH and the temperature of a developing solution are effective to increase the activity of the processing solution. However, any of these methods is accompanied by the degradation of the processing solution with the lapse of time, low contrast and the increase of the generation of fog.

Techniques of utilizing tabular grains to cope with these drawbacks are disclosed in U.S. Pat. Nos. 4,439,520 and 4,425,425. Also, there is disclosed in JP-A-58-111933 a photographic element for radiography which is endowed with a high covering power by using tabular grains to suppress swelling of the hydrophilic colloid layer to 200% or less and there is no use for additional hardening during processing. Further, techniques for improving the development progression and the sensitivity/fog ratio by controlling the development initiation point of the silver halide grains having {111} faces at the vertex and/or the edge and the neighborhood thereof of the grains are disclosed in JP-A-63-305343 and JP-A-1-77047. These known techniques are superior techniques for improving the development progression and useful.

A large quantity of materials adsorbing onto a silver halide, such as a spectral sensitizing dye and the like, are necessary to control the development initiation point to obtain silver halide grains which can provide a sufficient photographic density in a short developing time of 10 seconds or less using the above technique. However, the remaining color and fixing failure become conspicuous under the processing time of 35 seconds or less of dry to dry time.

Excessive chemical sensitization to obtain high sensitivity, in general, increases fog and extremely deteriorates the storage stability of the photographic material. In particular, in large grain size area, chemical sensitization has to be conducted until fog generates increasingly for achieving the increment of sensitivity corresponding to the increment of the surface area of the grain. Therefore, good sensitivity/fog ratio, development progression and storage stability cannot be obtained.

The present inventors have noticed as a result of extensive studies the partition rate of the gold in the silver halide grain side, and found that good sensitivity/fog ratio, development progression and storage stability could be obtained when the partition rate of the gold in the silver halide grain side was low. The present inventors have found that good photographic performances and storage stability could be obtained by raising the partition rate of the gold in the silver halide grain side one time by carrying out chemical sensitization using gold, selenium and sulfur in combination, and then lowering the partition rate of the gold in the silver halide grain side by the desorption of a part of the gold by a compound which forms a stable complex with the gold.

The technique for desorbing the gold from a silver halide emulsion by sodium sulfite is disclosed in L. Dupain-Klerkx and P. Faelens, *The Journal of Photographic Science* 35, pp. 136 to 144 (1987). However, the technique disclosed therein is a technique of bathing the silver halide emulsion coated after the completion of chemical sensitization to an aqueous sodium sulfite solution, which is not the addition of sodium sulfite to the silver halide emulsion during chemical sensitization. There is described, accordingly, that the gold in the binder phase is desorbed from the coated silver halide emulsion but the gold on the silver halide grain is not desorbed and 80% or more of the gold is distributed to the silver halide grain side in gold and sulfur sensitization. This point distinctly differs from the present invention. Further, this known example does not suggest at all that the emulsion of high sensitive and excellent in storage stability can be obtained by the desorption of the gold. In addition, only gold and sulfur sensitization is conducted in this known example, but the present inventors have found that the greatest effect of the present invention can be obtained, in particular, by gold and selenium sensitization.

There is disclosed in JP-A-62-240951 that the removal of the gold sensitizer remaining in the binder phase after completion of the gold sensitization of the silver halide emulsion heightens the partition rate of the gold in the silver halide grain side of the emulsion and this contributes to the storage stability. However, this known example conducted only the removal of the gold in the binder phase and did not intend to desorb later the gold once distributed to the silver halide grain side.

U.S. Pat. No. 3,442,653 discloses the addition of sulfite during chemical sensitization process simultaneously with gold sensitizer and stable selenium sensitizer to activate the stable selenium sensitizer in gold and selenium sensitization. The use of sulfite as a silver halide solvent to be added before the addition of a chemical sensitizer during chemical sensitization process is disclosed in JP-B-2-7445 (the term "JP-B" as used herein refers to an "examined Japanese patent publication"). The addition of sodium sulfite as a reducing material during chemical sensitization process before gold and sulfur sensitization is disclosed in JP-A-2-235043. However, all of these known examples are insufficient for the object of desorbing later the once reacted gold on the silver halide grains such as in the example mode of the present invention.

SUMMARY OF THE INVENTION

The object of the present invention is to provide a photographic material which is excellent in sensitivity/fog ratio, shows high development progression, excellent in storage stability and good in sharpness.

The above object of the present invention has been achieved by the following.

(1) A silver halide photographic material comprising a support having thereon at least one silver halide emulsion layer, wherein the silver halide grains contained in said silver halide emulsion layer has been gold and chalcogen sensitized, and the partition rate of the gold in the silver halide grain side is 10% or more and less than 40%.

(2) A method of producing a silver halide photographic material comprising a support having thereon at least one silver halide emulsion layer, wherein silver halide grains contained in the silver halide emulsion layer has been gold and chalcogen sensitized, and the partition rate of the gold in the silver halide grain side is made 10% or more and less than 40% by the addition of a compound which forms a complex with the gold after the partition rate of the gold in the silver halide grain side reached 50% or more in the chemical sensitization process.

(3) The method of producing a silver halide photographic material as described in (2), wherein the compound which forms a complex with the gold is a compound having the stability constant of the gold and the complex salt of from 28 to 39.

(4) The method of producing a silver halide photographic material as described in (2), wherein the compound which forms a complex with the gold is sulfite.

(5) The silver halide photographic material as described in (1) to (4), wherein the silver halide emulsion has been gold and chalcogen sensitized, and the method of producing the same.

(6) The silver halide photographic material as described in (1) to (5), wherein the silver halide grains are tabular grains having an average aspect ratio of 2 or more, and the method of producing the same.

(7) The silver halide photographic material as described in (1) to (5), wherein the silver halide grains are tabular grains having an average aspect ratio of 2 or more, and an average silver iodide content is 1 mol % or less based on the entire silver content, and the method of producing the same.

DETAILED DESCRIPTION OF THE INVENTION

The present invention is described in detail below.

A silver halide emulsion is, in general, prepared by mixing alkali halide and silver nitrate in the presence of gelatin, and through the process of any of the steps of below described known silver halide grain formation techniques, and the steps of physical ripening, cooling, washing, heating, chemical sensitization and cooling for solidification. Specifically speaking with the chemical sensitization, the silver halide emulsion prepared at first is desalted, washed, dispersed in new gelatin, and after the pH and pAg are adjusted, chemically sensitized by the addition of chemical sensitizers, typically gold sensitizers, more preferably gold sensitizers and chalcogen sensitizers. Various additives are added to the chemically sensitized emulsion and then the emulsion is coated on a support.

The present invention is attained by desorbing a part of the gold partitioned to the chemically sensitized silver halide grain side after the addition of chemical sensitizers.

The partition rate of the gold in the silver halide grain side in the present invention is 10% or more and less than 40%, more preferably 12% or more and less than 35%, and most preferably 15% or more and less than 30%.

The partition rate of the gold in the silver halide grain side is defined as follows from the amount of the gold in the silver halide grain phase and the total amount of the gold in the silver halide emulsion phase determined by the methods described below:

(The partition rate of the gold in the silver halide grain side)=(The amount of the gold in the silver halide grain phase)/(The total amount of the gold in the silver halide emulsion phase)

The determination of the amount of the gold in the silver halide grain phase and the determination of the total amount of the gold in the silver halide emulsion phase are specifically carried out according to the calorimetric analysis method, the atomic absorption method; the ICP emission spectral method, the neutron radioactivation method, the mass spectrometry and the like.

More specifically, analysis can be conducted by operation (i), (ii) or (iii) described below. Further, the total amount of the gold in the silver halide emulsion phase may be the sum total of the gold amount in the silver halide grain phase and that in the binder phase, or may be the determined value of the gold by analyzing the total of the silver halide emulsion without conducting operation (i), (ii) or (iii), or further may be the total amount of the gold added to the silver halide emulsion.

(i) When the silver halide emulsion to be analyzed is a silver halide emulsion dispersion before coating on a support, the silver halide emulsion dispersion is separated to the silver halide grain solid phase and the binder phase by a centrifugal separation method, and the amount of the gold sensitizer of each phase is determined according to the above analysis methods.

(ii) When the emulsion to be analyzed is a coated film on a support, the film is swollen with water and peeled off from the support by enzyme decomposition or acid decomposition, the silver halide emulsion peeled off is separated to the silver halide grain solid phase and the binder phase by a centrifugal separation method, and the amount of the gold sensitizer of each phase is determined according to the above analysis methods.

(iii) When the emulsion to be analyzed is a coated film on a support, the film is sufficiently washed with a diluted aqueous solution of sodium thiosulfate or potassium thiocyanate (e.g., a 0.01% aqueous solution) carefully so that the silver halide is not fixed. Thus, almost all the gold sensitizer in the binder phase is washed out. The amount of all the gold sensitizer in the film before and after sodium thiosulfate or potassium thiocyanate bath processing is determined to calculate the amount of the gold sensitizer in the silver halide grain phase and that in the binder phase. The details with respect to the operation (iii) are disclosed in P. A. Falens, *Photographische Korrespondenz*, Vol. 104, pp. 137 to 146 (1968).

The silver halide grains of the present invention are preferably such that the partition rate of the gold in the silver halide grain side is preferably lowered by the addition of a compound which forms a complex with the gold after the partition rate of the gold in the silver halide grain side becomes higher in the chemical sensitization process. The partition rate of the gold in the silver halide grain side immediately before the addition of a compound which forms a complex with the gold is preferably 50% or more, more preferably 55% or more, and most preferably 60% or more. The partition rate of the gold in the silver halide grain side after the completion of the chemical sensitization is preferably 10% or more and less than 40%, more preferably 12% or more and less than 35%, and most preferably 15% or more and less than 30%.

The ripening time from the addition of gold and chalcogen sensitizers to the addition of the compound which forms a complex with gold, necessary for making the partition rate of the gold in the silver halide grain side of not less than 50%, is not particularly limited, but generally strongly depends on, especially, the pAg of the emulsion, the silver halide grains used, the temperature in chemical sensitizing, and the chalcogen sensitizer used.

The time from the addition of the compound which forms a complex with gold to the completion of the chemical sensitization, necessary for making the partition rate of the gold in the silver halide grain side of not less than 10% and less than 40%, is not particularly limited, but generally depends on the pAg of the emulsion, the silver halide grains used, the temperature in chemical sensitizing, and the chalcogen sensitizer used.

A compound which forms a complex with the gold is preferably a compound having the stability constant of the gold and the complex salt of from 28 to 39. Specific examples of such a compound include thiosulfate, sulfite, cyanide, etc., and particularly preferably sulfite.

The amount of the compound which forms a complex with the gold for use in the present invention varies depending on the stability constant of the gold and the complex salt, the silver halide grains to be used, and the conditions of the chemical sensitization, but is from $10^{-8}$ to $10^{-2}$ mol, preferably from $10^{-7}$ to $5\times10^{-3}$ mol or so, per mol of the silver halide.

The chemical sensitization in the present invention is used in combination of chalcogen sensitization such as sulfur sensitization, selenium sensitization and tellurium sensitization, with gold sensitization.

Unstable sulfur compounds are used in sulfur sensitization, for example, the unstable sulfur compounds as disclosed in P. Glafkides, *Chimie et Physique Photographique*, 5th Edition, Paul Montel, 1987 and *Research Disclosure*, Vol. 307, No. 307105 can be used. Specific examples thereof include known sulfur compounds such as thiosulfate (e.g., hypo), thioureas (e.g., diphenylthiourea, triethylthiourea, N-ethyl-N'-(4-methyl-2-thiazolyl)thiourea, carboxymethyltrimethylthiourea), thioamides (e.g., thioacetamide), rhodanines (e.g., diethyl rhodanine, 5-benzylidene-N-ethyl rhodanine), phosphinesulfides (e.g., trimethylphosphinesulfide), thiohydantoins, 4-oxo-oxazolidine-2-thiones, disulfides or polysulfides (e.g., dimorpholinedisulfide, cystine, lenthionine), a mercapto compound (e.g., cysteine), polythionate, elemental sulfur and active gelatin.

Unstable selenium compounds are used in sulfur sensitization, for example, the unstable selenium compounds as disclosed in JP-B-43-13489, JP-B-44-15748, JP-A-4-25832, JP-A-4-109240, JP-A-4-271341 and JP-A-5-40324 can be used. Specific examples thereof include colloidal metal selenium, selenoureas (e.g., N,N-dimethylselenourea, trifluoromethylcarbonyltrimethylselenourea, acetyltrimethylselenourea), selenoamides (e.g., selenoacetamide, N,N-diethylphenylselenoamide), phosphineselenides (e.g., triphenylphosphineselenide, pentafluorophenyltriphenylphosphineselenide), selenophosphates (e.g., tri-p-tolylselenophosphate, tri-n-butylselenophosphate), seleno ketones (e.g., selenobenzophenone), isoselenocyanates, selenocarboxylic acids, seleno esters, and diacylselenides. In addition, the non-unstable selenium compounds, e.g., selenites, potassium selenocyanide, selenazoles and selenides as disclosed in JP-B-46-4553 and JP-B-52-34492 can also be used.

Unstable tellurium compounds are used in tellurium sensitization, for example, the unstable tellurium compounds as disclosed in Canadian Patent 800,958, British Patents 1,295,462, 1,396,696, JP-A-4-204640, JP-A-4-271341, JP-A-4-333043 and JP-A-5-303157 can be used. Specific examples thereof include tellurureas (e.g., tetramethyltellurourea, N,N'-dimethylethylenetellurourea, N,N'-diphenylethylenetellurourea), phosphinetellurides (e.g., butyldiisopropylphosphinetelluride, tributylphosphinetelluride, tributoxyphosphinetelluride, ethoxydiphenylphosphinetelluride), diacyl(di)tellurides (e.g., bis(diphenylcarbamoyl)ditelluride, bis(N-phenyl-N-methylcarbamoyl)ditelluride, bis(N-phenyl-N-methylcarbamoyl)telluride, bis(ethoxycarbonyl)telluride), isotellurocyanates, telluroamides, tellurohydrazides, telluro esters (e.g., butylhexyltelluro ester), telluro ketones (e.g., telluroacetophenone), colloidal tellurium, (di)tellurides, and other tellurium compounds (e.g., potassium telluride, sodium telluropentathionate).

The gold salts disclosed in the above P. Glafkides, *Chimie et Physique Photographique*, 5th Edition, Paul Montel, 1987, and Research Disclosure, Vol. 307, No. 307105 can be used in gold sensitization. Specifically, chloroauric acid, potassium chloroaurate, potassium aurithiocyanate, gold sulfide, gold selenide, as well as the gold compounds as disclosed in U.S. Pat. Nos. 2,642,361, 5,049,484 and 5,049,485 can be used. Further, noble metals such as platinum, palladium, iridium can also be used.

Chalcogen sensitization may be conducted alone or may be a combination of two or more, or may be combined with gold sensitization, a combination of selenium sensitization and gold sensitization is most preferred, a combination of sulfur sensitization, selenium sensitization and gold sensitization is also preferred. Reduction sensitization may be used in combination.

The amount of the chalcogen sensitizer for use in the present invention varies depending on the silver halide grains to be used or chemical sensitization conditions, but is from $10^{-8}$ to $10^{-2}$ mol, preferably from $10^{-7}$ to $5\times10^{-3}$ mol or so, per mol of the silver halide.

The amount of the gold sensitizer for use in the present invention is from $10^{-7}$ to $10^{-2}$ mol or so per mol of the silver halide. The amount of the noble metal sensitizer other than the gold sensitizer for use in the present invention may be from $10^{-7}$ to $10^{-2}$ mol or so per mol of the silver halide. The conditions of chemical sensitization in the present invention are not particularly limited but preferably the pAg is from 6 to 11, more preferably from 7 to 10, the pH is preferably from 4 to 10, and the temperature is preferably from 40° to 95° C., more preferably from 45° to 85° C.

The known reducing compounds as disclosed in the above P. Glafkides, *Chimie et Physique Photoqraphique,* 5th Edition, Paul Montel, 1987, and *Research Disclosure,* Vol. 307, No. 307105 can be used in reduction sensitization. Specifically, aminoiminomethanesulfinic acid (another name is thiourea dioxide), borane compounds (e.g., dimethylamineborane), hydrazine compounds (e.g., hydrazine, p-tolylhydrazine), polyamine compounds (e.g., diethylenetriamine, triethylenetetramine), stannous chloride, a silane compound, leductones (e.g., ascorbic acid), sulfite, an aldehyde compound, or hydrogen gas can be used. Reduction sensitization may be conducted at the atmosphere of high pH, or excessive silver ion (so-called silver ripening).

Silver halide grains having any halide composition may be used in the present invention, for example, silver chloride, silver bromide, silver iodobromide, silver iodochloride, silver chlorobromide and silver iodochlorobromide, but is preferably the content of tabular silver iodide is 10 mol % or less of the entire silver amount, more preferably 5 mol % or less, and most preferably 1 mol % or less. There is no limitation on the grain size of the silver halide grains for use in the present invention, but it is from 0.05 μm to 10 μm, preferably from 0.1 μm to 3 μm.

The silver halide grains for use in the present invention may have a regular crystal form (regular crystal grains) such as a hexahedral, octahedral, dodecahedral, tetradecahedral, tetracosahedral or octatetracontahedral form, or an irregular crystal form such as a spherical or potato-like form, or may be various forms of grains which have one or more twin planes, but tabular grains having an average aspect ratio of 2 or more is most preferred. The aspect ratio herein is expressed by diameter/thickness ratio, the diameter is a diameter of a circle having an area corresponding to the projected area of the grain, and the thickness is represented by a distance between two parallel planes comprising the tabular silver halide grains.

Tabular silver halide grains can be produced according to well known methods in the art in an arbitrary combination.

For example, tabular silver halide grains can be obtained by forming a seed crystal comprising 40% or more by weight of tabular grains under the comparatively high pAg atmosphere of pBr 1.3 or less and growing the seed crystal by adding silver and halide solutions simultaneously while keeping the pBr at about the same value.

Silver and halide solutions are preferably added so as not to generate new crystal nucleus during the grain growth.

The size of tabular silver halide grains can be controlled by adjusting the temperature, selecting the kind and amount of the solvents, and controlling the addition speed of the silver salt and halide for use during grain growth.

The grain size and the grain form (diameter/thickness ratio and the like), the grain size distribution and the grain growth speed can be controlled by using a silver halide solvent according to necessity during the production of tabular silver halide grains of the present invention. The amount used of the solvent is $10^{-3}$ to 1.0 wt %, particularly preferably from $10^{-2}$ to $10^{-1}$ wt %, of the reaction solution.

For example, it is possible to make the grain size distribution monodisperse and to increase the speed of the grain growth with the increase of the amount of the solvent. On the other hand, the thickness of the grain tends to increase with the increase of the amount of the solvent.

Ammonia, thioether and thioureas are frequently used as silver halide solvents. U.S. Pat. Nos. 3,271,157, 3,790,387 and 3,574,628 can be referred to with respect to thioethers.

The methods of increasing the addition speed, amount and concentration of the silver salt solution (e.g., an aqueous $AgNO_3$ solution) and the halide solution (e.g., an aqueous KBr solution) which are added to raise the speed of the grain growth during production of the tabular silver halide grains of the present invention are preferably used.

With respect to these methods, British Patent 1,335,925, U.S. Pat. Nos. 3,672,900, 3,650,757, 4,242,445, JP-A-55-142329 and JP-A-55-158124 can be referred to.

In the layer containing the tabular silver halide grains of the present invention, the tabular grains having aspect ratio of 2 or more accounts for from 50% to 100%, preferably from 60% to 100%, more preferably from 70% to 100%, in projected area ratio, based on the entire silver halide grains contained in the layer.

The thickness of the layer containing the tabular silver halide grains is from 0.3 to 5.0 μm, particularly preferably from 0.5 to 3.0 μm.

Other constitutions of the layer containing the tabular silver halide grains of the present invention, for example, a binder, a hardening agent, an antifoggant, a stabilizer for silver halide, a surfactant, a spectral sensitizing dye, a dye, an ultraviolet absorbing agent, a chemical sensitizer, and the like are not particularly limited and, for example, *Research Disclosure,* Vol. 176, pp. 22 to 28 (December, 1978) can be referred to.

When the emulsion layer of the silver halide photographic material of the present invention contains grains other than tabular silver halide grains, any production methods hitherto known can be used, that is, the addition of an aqueous silver salt solution and an aqueous halide solution to the reaction vessel containing an aqueous gelatin solution with efficient stirring. Specifically, the preparation is feasible according to the methods disclosed in P. Glafkides, *Chimie et Physique Photographigue,* Paul Montel (1967), G. F. Duffin, *Photographic Emulsion Chemistry,* The Focal Press (1966), V. L. Zelikman, et al., *Making and Coating Photographic Emulsion,* The Focal Press (1964), and so on. That is, any process, such as an acid process, a neutral process, and an ammoniacal process, can be used. Any of a single jet method, a double jet method, and combinations of these methods can be used for reacting a soluble silver salt with a soluble halide.

A so-called controlled double jet method, which is one form of a double jet method, in which the pAg of the liquid phase in which the silver halide is formed is maintained constant can also be used. Moreover, the method in which the rates of addition of the silver nitrate and the aqueous alkali halide solution are varied according to the grain growth rate as disclosed in British Patent 1,535,016, JP-B-48-36890 and JP-B-52-16364, and the method in which the concentrations of the aqueous solutions are varied as disclosed in U.S. Pat. No. 4,242,445 and JP-A-55-158124 are preferably used to rapidly grow grains within the range not exceeding the critical degree of saturation. These methods are preferably used because they do not generate new nuclei and silver halide grains grow uniformly.

A method in which previously prepared fine grains are added to a reaction vessel to start nucleus formation and/or grain growth to thereby obtain silver halide grains in place of adding a silver salt solution and a halide solution to a reaction vessel is preferably used. This technique is disclosed in JP-A-1-183644, JP-A-1-183645, U.S. Pat. No. 4,879,208, JP-A-2-44335, JP-A-2-43534 and JP-A-2-43535. According to this method, uniform distribution of halogen ion in the emulsion grain crystal can be obtained and preferred photographic characteristics can be obtained.

Emulsion grains of various structures can be used in the present invention. Grains comprising inside (core) part and outside (shell) part, that is, so-called core/shell type double structure grains, the triple structure grains as disclosed in JP-A-60-222844, or multilayer structure grains can be used. When producing emulsion grains having an inner structure, grains having a junction structure within the grains can also be produced not only the above described enveloped type structure. Examples thereof are disclosed in JP-A-59-133540, JP-A-58-108526, EP 199290A2, JP-B-58-24772 and JP-A-59-16254.

In a junction structure, the crystal to be joined having different composition from the host crystal can be grown at the edge or corner part, or on the surface of the host crystal. Such a junction crystal can be formed if the host crystal has a uniform halide composition throughout, or has a core/shell type structure.

The combination of silver halide with silver halide can of course be formed as a junction structure but silver salt compounds not having a rock salt structure such as silver thiocyanate and silver carbonate can be combined with silver halide and can form a junction crystal. Further, non-silver salt compound such as PbO can be used, if they can form a junction structure.

In the case of silver iodobromide grains of these structures, for example, in core/shell type grains, grains may have a structure in which the silver iodide content of the core part is high and the silver iodide content of the shell part is low, or conversely, grains may have a structure in which the silver iodide content of the core part is low and the silver iodide content of the shell part is high. Similarly, with respect to grains having a junction structure, the grains may have a structure in which the silver iodide content of the host crystal is high and the silver iodide content of the joined crystal is low, or the grains may have the converse structure. Further, when the grains have a non-uniform structure as described above, a boundary between the parts which differ in halide composition may have a clear interface, or the interface may be obscured by forming mixed crystals depending on the difference in halide composition. Also, a continuous change in structure may be made positively in the boundary.

The grains of the silver halide emulsion for use in the present invention may be processed to have round shapes as disclosed in EP-0096727B1 and EP-0064412B1, or may be processed to improve the surface quality as disclosed in DE-2306447C2 and JP-A-60-221320.

A surface latent image type silver halide emulsion is preferably used in the present invention, but an internal latent image type emulsion can also be used by selecting developing solutions and conditions of development. Also, a shallow internal latent image type emulsion covered with a thin shell can be used according to the purpose.

The silver halide grain having a dislocation line is preferably used in the present invention. Such grains having dislocation lines are disclosed in U.S. Pat. No. 4,806,461.

A cadmium salt, a zinc salt, a lead salt, a thallium salt, an iridium salt or a complex salt thereof, a rhodium salt or a complex salt thereof, or an iron salt or a complex salt thereof may be present during silver halide grain formation or physical ripening.

The emulsion of the present invention is in general spectrally sensitized. The dyes which are used for spectral sensitization include, for example, a cyanine dye, a merocyanine dye, a complex cyanine dye, a complex merocyanine dye, a holopolar cyanine dye, a hemicyanine dye, a styryl dye, and a hemioxonol dye. Particularly useful dyes are dyes belonging to a cyanine dye, a merocyanine dye and a complex merocyanine dye. Nuclei which are usually utilized as basic heterocyclic nuclei in cyanine dyes can be applied to these dyes. For example, a pyrroline nucleus, an oxazoline nucleus, a thiazoline nucleus, a selenazoline nucleus, a pyrrole nucleus, an oxazole nucleus, a thiazole nucleus, a selenazole nucleus, an imidazole nucleus, a tetrazole nucleus, a pyridine nucleus, a tellurazole nucleus, etc.; the above nuclei to which alicyclic hydrocarbon rings are fused; the above nuclei to which aromatic hydrocarbon rings are fused, that is, an indolenine nucleus, a benzindolenine nucleus, an indole nucleus, a benzoxazole nucleus, a naphthoxazole nucleus, a benzimidazole nucleus, a naphthoimidazole nucleus, a benzothiazole nucleus, a naphthothiazole nucleus, a benzoselenazole nucleus, a naphthoselenazole nucleus, a quinoline nucleus and a benzotellurazole nucleus can be used. These heterocyclic nucleus may be substituted on the carbon atoms.

Nuclei which are usually utilized as nuclei having ketomethylene structures in merocyanine dyes can be applied to merocyanine and complex merocyanine dyes. Particularly useful nuclei which can be applied are a 5- or 6-membered heterocyclic nucleus such as a pyrazoline-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus, and a 2-thioselenazolidine-2,4-dione nucleus.

These sensitizing dyes may be used alone or may be used in combination. A combination of a sensitizing dye is often used for the purpose of supersensitization. Representative examples thereof are disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,614,609, 3,837,862, 4,026,707, British Patents 1,344,281, 1,507,803, JP-B-43-4936, JP-B-53-12375, JP-A-52-110618 and JP-A-52-109925.

Further, these sensitizing dyes may be used in combination with dyes which themselves do not show a spectral sensitizing function or materials substantially do not absorb visible light but show conspicuous increase of spectral sensitization when combined with sensitizing dyes, that is, the compounds known as supersensitizers. Representative examples of supersensitizers include the bispyridinium salt compounds disclosed in JP-A-59-142541, the stilbene derivatives disclosed in JP-B-59-18691, the water-soluble bromide and the water-soluble iodide such as the potassium bromide and the potassium iodide disclosed in JP-B-49-46932, the fused compounds of aromatic compound and formaldehyde, cadmium salts and azaindene compounds disclosed in U.S. Pat. No. 3,743,510.

Sensitizing dyes are added after chemical ripening or before chemical ripening. The sensitizing dyes are most preferably added to the silver halide grains of the present invention during chemical ripening or before chemical ripening (for example, during grain formation, during physical ripening).

Various compounds can be added to the photographic emulsion of the present invention for preventing generation of fog or stabilizing photographic performances during production, storage or processing of the photographic material. Such compounds include compounds known as an antifoggant or a stabilizer such as azoles, e.g., benzothiazolium salt, nitroindazoles, triazoles, benzotriazoles, benzimidazoles (particularly nitro- or halogen-substitution product); heterocyclic mercapto compounds, e.g., mercaptothiazoles, mercaptobenzothiazoles, mercaptobenzimidazoles, mercaptothiadiazoles, mercaptotetrazoles (particularly, 1-phenyl-5-mercaptotetrazole), mercaptopyrimidines; the above heterocyclic mercapto compounds having water-soluble groups such as carboxyl groups or sulfone groups; thioketo compound, e.g., oxazolinethione; azaindenes, e.g., tetraazaindenes (particularly, 4-hydroxy-substituted(1,3,3a,7)-tetraazaindenes); benzenethiosulfonic acids; and benzenesulfinic acid.

A thiocyanic acid compound may be added to the emulsion layer for use in the present invention in an amount of $1.0\times10^{-3}$ mol or more and less than $2.0\times10^{-2}$ mol per mol of silver. The addition of the thiocyanic acid compound may be any step of grain formation, physical ripening, grain growth, chemical sensitization and coating, but the addition before chemical sensitization is preferred.

As the thiocyanic acid compound for use during adjustment of the silver halide emulsion of the present invention, water-soluble salt such as a thiocyanic acid metal salt or an ammonium salt may be generally used, but in the case of a metal salt, precaution must be taken to use metal elements which do not adversely affect the photographic performances, for example, a potassium salt and a sodium salt are preferred. A hardly soluble salt such as AgSCN may be added in the form of fine grains.

These antifoggants or stabilizers are usually added after chemical sensitization, but more preferably the addition time can be selected from the time during chemical sensitization or the time before the commencement of chemical sensitization.

The silver halide emulsion produced according to the method of the present invention can be used, for example, for a color photographic material for photographing (a color negative film, a color reversal film), a photographic material for printing, a photographic material for X-ray use, a black-and-white photographic material for photographing, a material for photomechanical process, a photographic paper and the like.

The various additives for use in photographic materials are not particularly limited other than described above and those described in the following corresponding places can be used.

| Item | Places |
|---|---|
| 1) Silver halide emulsion and the preparation method | line 6, right lower column, page 8 to line 12, right upper column, page 10 of JP-A-2-68539; line 10, right lower column, page 2 to line 1, right upper column, page 6 of JP-A-3-24537; line 16, left upper column, page 10 to line 19, left lower column, page 11 of JP-A-3-24537; and Japanese patent application Ser. No. 2-225637 |
| 2) Method of chemical sensitization | line 13, right upper column, page 10 to line 16, left upper column of JP-A-2-68539; and Japanese patent application Ser. No. 3-105035 |
| 3) Antifoggant and stabilizer | line 17, left lower column, page 10, to line 7, left upper column, page 11 of JP-A-2-68539; and line 2, left lower column, page 3 to left lower column, page 4 of JP-A-2-68539 |
| 4) Tone improving agent | line 7, left lower column, page 2 to line 20, left lower column, page 10 of JP-A-62-276539; and line 15, left lower column, page 6 to line 19, right upper column, page 11 of JP-A-3-94249 |
| 5) Spectral sensitizing dye | line 4, right lower column, page 4 to right lower column, page 8 of JP-A-2-68539 |
| 6) Surfactant and antistatic agent | line 14, left upper column, page 11 to line 9, left upper column, page 12 of JP-A-2-68539 |
| 7) Matting agent, sliding agent and plasticizer | line 10, left upper column, page 12 to line 10, right upper column, page 12 of JP-A-2-68539; and line 10, left lower column, page 14 to line 1, right lower column, page 14 of JP-A-2-68539 |
| 8) Hydrophilic colloid | line 11, right upper column, page 12 to line 16, left lower column, page 12 of JP-A-2-68539 |
| 9) Hardening agent | line 17, left lower column, page 12 to line 6, right upper column, page 13 of JP-A-2-68539 |
| 10) Support | from line 7 to line 20, right upper column, page 13 of JP-A-2-68539 |
| 11) Crossover cut method | line 20, right upper column, page 4 to right upper column, page 14 of JP-A-2-264944 |
| 12) Dye and mordant | line 1, left lower column, page 13 to line 9, left lower column, page 14 of JP-A-2-68539; and left lower column, page 14 to right lower column, page 16 of JP-A-3-24539 |
| 13) Polyhydroxybenzenes | left upper column, page 11 to left lower column, page 12 of JP-A-3-39948; and EP 452772A |
| 14) Layer structure | JP-A-3-198041 |
| 15) Development processing method | line 7, right upper column, page 16 to line 15, left lower column, page 19 of JP-A-2-103037; and line 5, right lower column, page 3 to line 10, right upper column, page 6 of JP-A-2-115837 |

EXAMPLE 1

6.9 g of potassium bromide and 11.5 g of low molecular weight gelatin having an average molecular weight of 15,000 were added to 1 liter of water, and 22 cc of an aqueous solution of silver nitrate (silver nitrate: 2.40 g) and 39 cc of an aqueous solution containing 5.9 g of potassium bromide were added, with stirring, to the vessel maintained at 74° C. by a double jet method over 37 seconds. Subsequently, 26 g of gelatin was added thereto, then 104 cc of an aqueous solution of silver nitrate (silver nitrate: 11.6 g) was added over 11 minutes and 30 seconds. 18 cc of a 25% aqueous solution of ammonia was added to the mixture, and physical ripening was carried out for 10 minutes while maintaining the temperature at 74° C., then 19 cc of a 100% solution of acetic acid was added. Subsequently, an aqueous solution containing 188 g of silver nitrate and an aqueous solution of potassium bromide were added by a controlled double jet method over 55 minutes with maintaining pAg at 8.4. The flow rate at this time was accelerated so that the final flow rate was 2.8 times of the flow rate at the start of the addition. After the termination of addition, 44 cc of a 2N potassium thiocyanate solution was added. Physical ripening was carried out for 5 minutes while keeping the same temperature, then the temperature was lowered to 35° C. and the soluble salts were removed by the precipitation method, then the temperature was raised to 40° C. and 43 g of gelatin, 2.1 g of phenoxyethanol, and a tackifier were added thereto, and the pH and the pAg of the emulsion were adjusted to 6.1 and 7.8, respectively, using sodium hydroxide, potassium bromide and an aqueous silver nitrate solution. The temperature was raised to 56° C., and immediately after the addition of an aqueous solution containing 0.084 g of potassium bromide and 5.4 mg of sodium ethylthiosulfonate, 0.11 mol %, based on the entire amount of silver, of AgI fine grains having a diameter of 0.03 gm was added. Subsequently, 0.76 g of calcium chloride was added, and 7 minutes after, 538 mg of Sensitizing A-1 and 2.1 mg of Sensitizing A-2 having the structural formulae shown below were added, and allowed to stand for 5 minutes for adsorption, then 1.7 mg of chloroauric acid and 81 mg of potassium thiocyanate were added, then 0.28 mg of sodium thiosulfate and 0.81 mg of selenium compound A-3 were further added and ripening was carried out for 60 minutes. Subsequently, 24 mg of sodium sulfite was added and further ripened, 105 minutes after the addition of the chloroauric acid, the reaction system was solidified by quenching. Thus, Emulsion T-1 was prepared.

Emulsions T-2 to T-7 were prepared in the same manner as the preparation of T-1 except that the addition amounts and the time from the addition of the chloroauric acid to the addition of the sodium sulfite were changed as indicated in Table 1. Further, Emulsion T-8 was prepared in the same manner except that the selenium sensitizer was not added.

Compound A-1

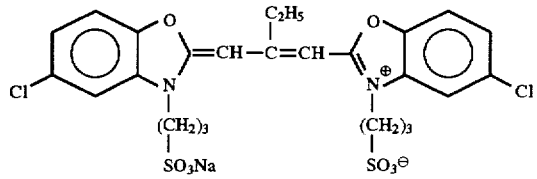

Compound A-2

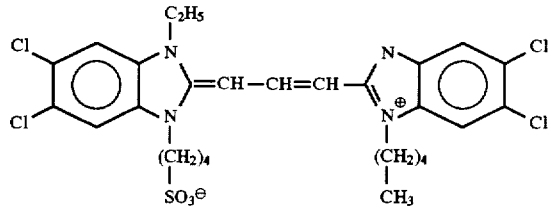

Compound A-3

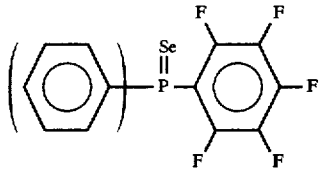

TABLE 1

| Emulsion | Addition Amount of Sodium Sulfite (mg) | Time from the Addition of Chloroauric Acid to the Addition of Sodium Sulfite (min) | Partition Rate of the Gold in the Silver Halide Grain Side Immediately before Addition of Sodium Sulfite (%) | Partition Rate of the Gold in the Silver Halide Grain Side at the Time of Completion of Chemical Sensitization (%) | Remarks |
|---|---|---|---|---|---|
| T-1 | 24 | 60 | 70 | 25 | Invention |
| T-2 | 0 | — | — | 70 | Comparison |
| T-3 | 24 | −20 (before the addition of chloroauric acid) | 0 | 5 | Comparison |
| T-4 | 24 | 0 | 0 | 3 | Comparison |
| T-5 | 24 | 5 | 15 | 8 | Comparison |
| T-6 | 24 | 10 | 30 | 9 | Comparison |
| T-7 | 36 | 40 | 65 | 20 | Invention |
| T-8 | 24 | 60 | 70 | 5 | Comparison |

Each of the thus obtained emulsion and the emulsion immediately before the addition of sodium sulfite (prepared separately by the same formulation) was separated to the binder phase and the silver halide grain phase by centrifugation. The amount of the gold of silver halide emulsion phase was determined by the atomic absorption method after dissolving the silver halide grains with an aqueous solution of ammonium thiosulfite, the partition rate of the gold in the silver halide grain side was calculated from the determined value of the gold in the binder phase.

The partition rates of the gold in the silver halide grain side of Emulsions T-1 to T-8 are shown in Table 1.

70% of the sum total of the projected area of the grains of the thus obtained emulsion comprised grains having an aspect ratio of 5 or more, and all the grains having an aspect ratio of 3 or more had an average projected area diameter of 1.9 μm, a standard deviation coefficient of 22%, an average grain thickness of 0.3 μm, an average aspect ratio of 7.

Preparation of Coating Solution for Emulsion

The following compounds were added to the above chemically sensitized emulsion in the amount described below per mol of the silver halide to prepare a coating solution.

| | |
|---|---|
| Gelatin (including gelatin in the emulsion) | 111 g |
| Dextran (average molecular weight: 39,000) | 21.5 g |
| Sodium Polyacrylate (average molecular weight: 400,000) | 5.1 g |
| Sodium Polystyrenesulfonate (average molecular weight: 600,000) | 1.2 g |
| Potassium Iodide | 78 mg |
| Hardening Agent, 1,2-Bis(vinylsulfonylacetamido)ethane | Amount added was adjusted as to obtain a swelling rate of 230% |
| Compound A-4 | 42.1 mg |
| Compound A-5 | 10.3 g |
| Compound A-6 | 0.11 g |
| Compound A-7 | 8.5 mg |
| Compound A-8 | 0.43 g |
| (pH adjusted to 6.1 with NaOH) | |

Compound A-4

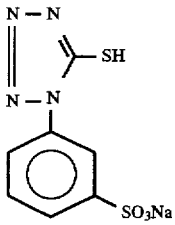

Compound A-5

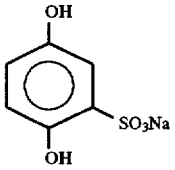

Compound A-6

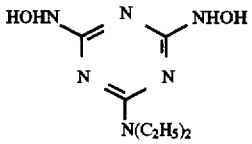

Compound A-7

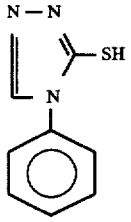

Compound A-8

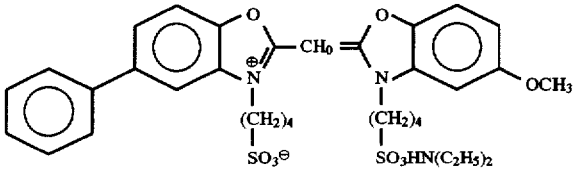

Dye Emulsion a was added to the above coating solution as to provide a coating weight of Compound A-9 of 10 mg/m$^2$ per one side.

Compound A-9

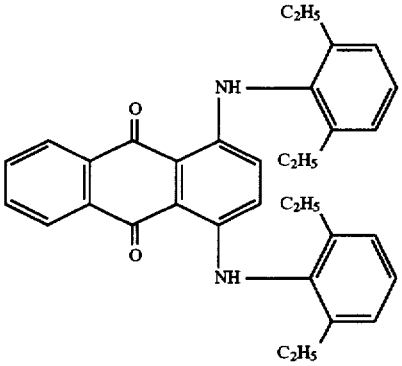

Preparation of Dye Emulsion a 60 g of the above Compound A-9, 62.8 g of 2,4-diaminophenol, 62.8 g of dicyclohexyl phthalate and 333 g of ethyl acetate were dissolved at 60° C. Then, 65 cc of a 5% aqueous solution of sodium dodecylbenzenesulfonate, 94 g of gelatin and 581 cc of water were added to the solution, and dispersed in an emulsion condition using a dissolver over 30 minutes. Then, 2 g of methyl p-hydroxybenzoate and 6 liters of water were added and the temperature was lowered to 40° C. Subsequently, the emulsion was concentrated until the total weight reached 2 kg using ultrafiltration labo module ACP1050 manufactured by Asahi Kasei Industry Co., Ltd., and 1 g of methyl p-hydroxybenzoate was added thereto to obtain Dye Emulsion a.

Preparation of Coating Solution for Surface Protective Layer

The surface protective layer was prepared so that the coating weight of each composition became as indicated below.

| | |
|---|---|
| Gelatin | 0.780 g/m$^2$ |
| Sodium Polyacrylate (average molecular weight: 400,000) | 0.025 g/m$^2$ |
| Sodium Polystyrenesulfonate (average molecular weight: 600,000) | 0.0012 g/m$^2$ |
| Polymethyl Methacrylate (average particle size: 3.7 μm) | 0.072 g/m$^2$ |
| Compound A-10 | 0.018 g/m$^2$ |
| Compound A-11 | 0.037 g/m$^2$ |
| Compound A-12 | 0.0068 g/m$^2$ |
| Compound A-13 | 0.0032 g/m$^2$ |
| Compound A-14 | 0.0012 g/m$^2$ |
| Compound A-15 | 0.0022 g/m$^2$ |
| Compound A-16 (Proxel) | 0.0010 g/m$^2$ |
| (pH adjusted to 6.8 with NaOH) | |

Compound A-10

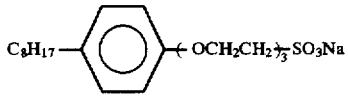

Compound A-11

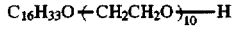

-continued

Compound A-12

$C_{17}H_{33}CON(CH_3)CH_2CH_2SO_3Na$

Compound A-13

$C_8F_{17}SO_2N(C_3H_7)(CH_2CH_2O)_{10}H$

Compound A-14

$C_8F_{17}SO_2N(C_3H_7)(CH_2CH_2O)_4(CH_2)_4SO_3Na$

Compound A-15

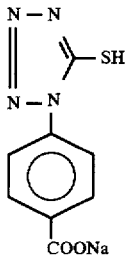

Compound A-16

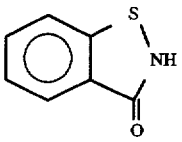

Preparation of Support (1) Preparation of Dye Dispersion B for Subbing Layer

The following Compound A-17 was treated by a ball mill according to JP-A-63-197943.

Compound A-17

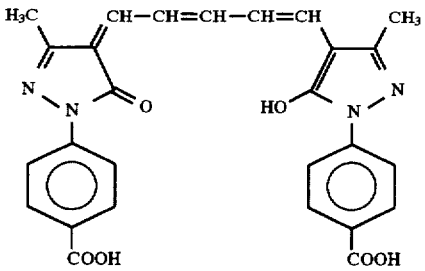

434 cc of water and 791 cc of a 6.7% aqueous solution of surfactant Triton X-200 (trade name) (TX-200) were put in a ball mill having a capacity of 2 liters. 20 g of the dye was added to the solution. 400 ml of beads of zirconium oxide ($ZrO_2$) (diameter: 2 mm) was added thereto and the content was pulverized over 4 days. After that, 160 g of 12.5% gelatin was added. After defoaming, $ZrO_2$ beads were removed by filtration. As a result of the observation, the diameter of the pulverized dye accounted for a wide range of from 0.05 to 1.15 μm and the average grain size was 0.37 μm.

The dye grains of 0.9 μm or more were removed by centrifugal operation.

Thus, Dye Dispersion B was obtained.

(2) Preparation of Support

A biaxially stretched polyethylene terephthalate film having a thickness of 175 μm was corona discharged, the first subbing layer having the following composition was coated by a wire bar coater so that the coating amount reached 4.9 cc/m$^2$, and then dried at 185° C. for 1 minute.

Then, the first subbing layer was also coated on the opposite side similarly. The polyethylene terephthalate used contained 0.04 wt % of Compound A-9.

| | |
|---|---|
| Solution of Butadiene-Styrene Copolymer Latex (solid part: 40%, weight ratio of butadiene/styrene = 31/69) | 158 cc |
| 4% Solution of Sodium 2,4-Dichloro-6-hydroxy-s-triazine | 41 cc |
| Distilled Water | 801 cc |

* In a latex solution, 0.4 wt %, based on the solid part of the latex, of Compound A-18 was contained as an emulsifying dispersant.

Compound A-18

$n\text{-}C_6H_{13}OOCCH_2$
$n\text{-}C_6H_{13}OOCCH(SO_3Na)$ (3) Coating of Subbing Layer On the first subbing layers of the above both surfaces were coated the second subbing layer having the following composition so as to provide the coating amount indicated below, one by one using a wire bar coater at 55° C., and then dried.

| | |
|---|---|
| Gelatin | 80 mg/m$^2$ |
| Dye Dispersion B (as dye solid part) | 8 mg/m$^2$ |
| Compound A-19 | 1.8 mg/m$^2$ |
| Compound A-16 | 0.27 mg/m$^2$ |
| Matting Agent (polymethyl methacrylate having an average particle size of 2.5 μm) | 2.5 mg/m$^2$ |
| Compound A-19 $C_{12}H_{25}O(CH_2CH_2O)_{10}H$ | |

$C_{12}H_{25}O(CH_2CH_2O)_{10}H$

Preparation of Photographic Material

On the above prepared support, the aforementioned emulsion layer and the surface protective layer were coated by a double extrusion method. The coating amount per one side was 1.75 g/m$^2$. The coating amount of gelatin and the swelling rate calculated by freeze drying method by liquid nitrogen were adjusted by the gelatin and the hardening agent added to the emulsion layer.

Thus, Coating Sample No. 1 to No. 8 corresponding to Emulsion T-1 to T-8 were prepared.

Evaluation of Photographic Performance

Coating Sample Nos. 1 to 8 were exposed to green light, development processed with Developing Solution (I) at 35° C. for 8 sec and 24 sec, and fixed, washed and dried.

Developinq Solution (I)

| | |
|---|---|
| 1-Phenyl-3-pyrazolidone | 1.5 g |
| Hydroxy | 30 g |
| 5-Nitroindazole | 0.25 g |
| Potassium Bromide | 3.0 g |
| Anhydrous Sodium Sulfite | 50 g |
| Sodium Hydroxide | 30 g |
| Boric Acid | 5 g |
| Glutaraldehyde | 10 g |
| Water to make | 1 liter |
| (pH was adjusted to 10.20) | |

The reciprocal of the exposure amount providing a density of Fog+1.0 was taken as the sensitivity, and the Coating Sample No. 1 developed for 24 sec. was taken as 100.

Evaluation of Natural Aging

Each Coating Sample was put in a closed container maintained at 50° C. 68% RH for 5 days (forced aging). This sample and comparative sample (stored in a green room contained in a light-shielding box) were processed according to the same processing used for photographic evaluation and the density of fog part was measured. Natural aging was evaluated as fog rate.

[(fog increase by forced aging)/{(maximum density)−(density of the support)}]×100

The lower the fog rate, the better is the natural aging. The results are shown in Table 2.

TABLE 2

| Coating Sample No. | Sensitivity | Fog | Increase of Fog Rate by Forced Aging |
|---|---|---|---|
| No. 1 | 100 | 0.18 | 2.5 |
| No. 2 | 80 | 0.25 | 9.3 |
| No. 3 | 20 | 0.19 | 3.0 |
| No. 4 | 25 | 0.20 | 3.1 |
| No. 5 | 28 | 0.21 | 4.2 |
| No. 6 | 30 | 0.23 | 4.7 |
| No. 7 | 105 | 0.19 | 2.3 |
| No. 8 | 22 | 0.20 | 3.0 |

As can be seen from Table 2, the emulsion of the present invention shows excellent photographic performance.

Further, as a result of the processing using an automatic processor described below the same thing was confirmed.

Processing

Automatic Processor: Drive motor and gear part of FPM-9000 manufactured by Fuji Photo Film Co., Ltd. were modified to raise the transporting speed Concentrated Developing Solution

| | |
|---|---|
| Potassium Hydroxide | 56.6 g |
| Sodium Sulfite | 200 g |
| Diethylenetriaminepentaacetic Acid | 6.7 g |
| Potassium Carbonate | 16.7 g |
| Boric Acid | 10 g |
| Hydroquinone | 83.3 g |
| Diethylene Glycol | 40 g |
| 4-Hydroxymethyl-4-methyl-1-phenyl-3-pyrazolidone | 22.0 g |

-continued

| | |
|---|---|
| 5-Methylbenzotriazole | 2 g |
| Processing Aid-I | 0.6 g |
| Processing Aid-I | |

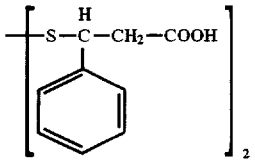

| | |
|---|---|
| Water to make | 1 liter |
| (pH was adjusted to 10.60) | |

Concentrated Fixing Solution

| | |
|---|---|
| Ammonium Thiosulfate | 560 g |
| Sodium Sulfite | 60 g |
| Disodium Ethylenediaminetetraacetate Dihydrate | 0.10 g |
| Sodium Hydroxide | 24 g |
| Water to make | 1 liter |
| (pH was adjusted to 5.10 with acetic acid) | |

At the beginning of development processing, each tank of the automatic processor was filled with the following processing solution.

Developing tank: 33 ml of the above concentrated developing solution, 667 ml of water, and a starter containing 2 g of potassium bromide and 1.8 g of acetic acid was added to adjust pH to 10.25

Fixing tank: 200 ml of the above concentrated developing solution, and 800 ml of water Processing speed: Dry to Dry: 35 sec Development temperature: 35° C.

Fixing temperature: 32° C.

Drying temperature: 55° C.

Replenishment rate: Developing solution: 21 ml/10×12 inch

Fixing solution: 30 ml/10×12 inch

Further, the processing by the following processor established the same fact.

Developing Solution Formulation

| | |
|---|---|
| Part A | |
| Potassium Hydroxide | 270 g |
| Potassium Sulfite | 1,125 g |
| Diethylenetriaminepentaacetic Acid | 30 g |
| Sodium Carbonate | 450 g |
| Boric Acid | 75 g |
| Hydroquinone | 405 g |
| 4-Methy1-4-hydroxymethyl-1-phenyl-3-pyrazolidone | 30 g |
| Diethylene Glycol | 150 g |
| 1-(Diethylamino)ethyl-5-mercaptotetrazole | 1 g |
| Water to make | 4.7 liters |
| Part B | |
| Triethylene Glycol | 700 g |
| 5-Nitroindazole | 4 g |
| Acetic Acid | 90 g |
| 1-Phenyl-3-pyrazolidone | 50 g |
| 3,3'-Dithiobishydrocinnamic Acid | 6 g |
| Water to make | 850 ml |
| Part C | |
| Glutaraldehyde | 75 g |

-continued

| | |
|---|---|
| Potassium Metabisulfite | 75 g |
| Water to make | 850 ml |

Water was added to Part A, Part B and Part C to make 15 liters and made as replenisher formulations (pH at this time: about 10.5). Each of Parts A, B and C were filled in Fuji Film CEPROS-30 cartridge for developing solution and set in automatic processor CEPROS-30, and replenished every 10 sheets processing of 10×12 inch size film.

Part A: 31.3 ml

Part B: 5.7 ml

Part C: 5.7 ml

Water: 57.3 ml (Total 100 ml): replenished 10 ml per one sheet of quarter size 150 g of KBr and 150 g of acetic acid were added to 1.5 liters of the above replenisher and this was used as the developing mother solution. CE-F1 manufactured by Fuji Photo Film Co., Ltd. was used as a fixing solution.

Running processing of 100 sheets of a quarter size (10 inch×12 inch) per one day was conducted using Fuji Medical X-ray Film Super HRS30, Super HRA30, Super HRHA30, Super HRL30, Super HRG30, MI-NP30, UR-1, UR-2, and LI-LM film for Fuji Laser Imager with CEPROS-30 automatic processor manufactured by Fuji Photo Film Co., Ltd. at 35° C.. Dry to Dry time of 46 sec. Excellent photographic performance and excellent washing ability with less remaining silver and remaining hypo were obtained.

EXAMPLE 2

6.2 g of gelatin having an average molecular weight of 15,000 and 6.9 g of potassium bromide were added to 1 liter of water, and an aqueous solution of silver nitrate containing 4.0 g of silver nitrate and an aqueous solution containing 5.9 g of potassium bromide were added, with stirring, to the vessel maintained at 40° C. by a double jet method over 37 seconds. Subsequently, an aqueous solution containing 18.6 g of gelatin was added thereto, then an aqueous solution containing 9.8 g of silver nitrate was added over 22 minutes and the temperature was raised to 60° C. 5.9 ml of a 25% aqueous solution of ammonia was added to the mixture, and after 10 minutes an aqueous solution containing 5.5 g of acetic acid was added. Subsequently, an aqueous solution containing 151 g of silver nitrate and an aqueous solution of potassium bromide were added by a controlled double jet method over 35 minutes with maintaining the potential at pAg 8.8. The flow rate at this time was accelerated so that the final flow rate was 14 times of the flow rate at the start of the addition. Potassium hexachloroiridate(III) was dissolved in this aqueous potassium bromide solution so as to reach the addition amount of 25 μg. After the termination of addition, 15 ml of a 2N potassium thiocyanate solution was added. Then, the temperature was lowered to 35° C. and the soluble salts were removed by the precipitation method, then the temperature was raised to 40° C. and 35 g of gelatin, 85 mg of Proxel, and a tackifier were added thereto, and the pH and the pAg of the emulsion were adjusted to 6.1 and 7.8, respectively, using sodium hydroxide, potassium bromide and an aqueous silver nitrate solution. The temperature was raised to 56° C., and immediately after the addition of 3 mg of sodium ethylthiosulfonate, 0.1 mol %, based on the entire amount of silver, of AgI fine grains having a diameter of 0.07 μm was added. Subsequently, 0.04 mg of thiourea dioxide was added, then $1.2\times10^{-3}$ mol/mol Ag of 4-hydroxy-6-methyl-1,3,3a,7-tetraazaindene and $7.2\times10^{-4}$ mol/mol Ag of Compound A-1 were added. After 10 minutes, $0.52\times10^{-5}$ mol/mol Ag of triphenylphosphineselenide, $1.03\times10^{-5}$ mol/molAg of sodium thiosulfate, 30 mg of potassium thiocyanate and 6 mg of chloroauric acid were added and ripening was carried out for 60 minutes. Subsequently, 24 mg of sodium sulfite was added and further ripened, 105 minutes after the addition of the chloroauric acid, the reaction system was solidified by quenching. 93% of the sum total of the projected area of the grains of the thus obtained emulsion comprised grains having an aspect ratio of 3 or more, and all the grains having an aspect ratio of 3 or more had an average projected area diameter of 0.83 μm, a standard deviation coefficient of 15%, an average grain thickness of 0.14 μm, an average aspect ratio of 6.2. Thus, Emulsion T-9 was prepared.

Emulsions T-10 to T-15 were prepared in the same manner as the preparation of T-9 except that the addition amounts and the time from the addition of the chloroauric acid to the addition of the sodium sulfite were changed as indicated in Table 3. Further, Emulsions T-16 and T-17 were prepared in the same manner except that equimolar amount of potassium thiocyanate (stability constant of gold and the complex salt: 20) and KBr (stability constant of gold and the complex salt: 15) were added in place of sodium sulfite in Emulsion T-9.

Each of the thus obtained emulsion and the emulsion immediately before the addition of sodium sulfite (prepared separately by the same formulation) was separated to the binder phase and the silver halide grain phase by centrifugation. The amount of the gold of silver halide emulsion phase was determined by the atomic absorption method after dissolving the silver halide grains with an aqueous solution of ammonium thiosulfite, the partition rate of the gold in the silver halide grain side was calculated from the determined value of the gold in the binder phase.

The partition rates of the gold in the silver halide grain side of Emulsions T-9 to T-17 are shown in Table 3.

TABLE 3

| Emulsion | Addition Amount of Sodium Sulfite (mg) | Time from the Addition of Chloroauric Acid to the Addition of Sodium Sulfite (min) | Partition Rate of the Gold in the Silver Halide Grain Side Immediately before Addition of Sodium Sulfite (%) | Partition Rate of the Gold in the Silver Halide Grain Side at the Time of Completion of Chemical Sensitization (%) | Remarks |
|---|---|---|---|---|---|
| T-9 | 24 | 60 | 75 | 28 | Invention |
| T-10 | 0 | — | — | 78 | Comparison |
| T-11 | 24 | −15 (before the | 0 | 6 | Comparison |

TABLE 3-continued

| Emulsion | Addition Amount of Sodium Sulfite (mg) | Time from the Addition of Chloroauric Acid to the Addition of Sodium Sulfite (min) | Partition Rate of the Gold in the Silver Halide Grain Side Immediately before Addition of Sodium Sulfite (%) | Partition Rate of the Gold in the Silver Halide Grain Side at the Time of Completion of Chemical Sensitization (%) | Remarks |
|---|---|---|---|---|---|
| | | addition of chloroauric acid) | | | |
| T-12 | 24 | 0 | 0 | 7 | Comparison |
| T-13 | 24 | 5 | 10 | 8 | Comparison |
| T-14 | 24 | 15 | 40 | 9 | Comparison |
| T-15 | 12 | 70 | 85 | 29 | Invention |
| T-16 | KSCN 18.5 | 60 | 75 | 70 | Comparison |
| T-17 | KBr 22.7 | 60 | 75 | 75 | Comparison |

Preparation of Coating Solution for Emulsion

Coating Solution for Emulsion

The following compounds were added to the above chemically sensitized emulsion in the amount described below per mol of the silver halide to prepare a coating solution.

| | |
|---|---|
| Gelatin | 85 g |
| 2,6-Bis(hydroxyamino)-4-diethylamino-1,3,5-triazine | 72.0 mg |
| Dextran (average molecular weight: 39,000) | 3.9 g |
| Sodium Polystyrenesulfonate (average molecular weight: 600,000) | 0.7 g |
| Compound A-4 | 7.0 mg |
| Compound A-7 | 16.0 mg |
| Compound A-8 | 200 mg |
| Sodium Hydroquinonemonosulfonate | 8.2 g |
| Snowtex C (Nissan Chemical Co., Ltd.) | 10.5 g |
| Ethyl Acrylate/Methacrylic Acid (97/3) Copolymer Latex | 9.7 g |
| Gelatin | adjusted so as to obtain a coating amount of emulsion layer of 2.6 g/m² |
| Hardening Agent (1,3-bis (vinylsulfonyl-acetamido)-ethane) | (adjusted so as to obtain swelling rate of 230%) |

Preparation of Coating Solution for Surface Protective Layer

The surface protective layer was prepared so that the coating weight of each composition became as indicated below.

| | |
|---|---|
| Gelatin | 650 mg/m² |
| Sodium Polyacrylate (average molecular weight: 400,000) | 18 mg/m² |
| Butyl Acrylate/Methacrylic Acid (4/6) Copolymer Latex (average molecular weight: 120,000) | 120 mg/m² |
| Compound A-10 | 18 mg/m² |
| Compound A-11 | 45 mg/m² |
| Compound A-13 | 0.9 mg/m² |
| Compound A-14 | 0.61 mg/m² |
| Compound A-20 | 26 mg/m² |

-continued

Compound A-20

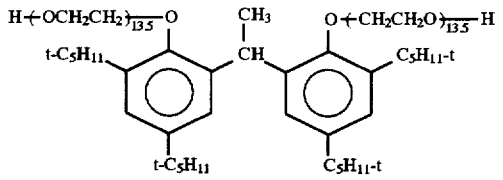

| | |
|---|---|
| Compound A-15 | 1.3 mg/m² |
| Polymethyl Methacrylate (average particle size: 2.5 μm) | 87 mg/m² |
| Proxel | 0.5 mg/m² |
| Potassium Polystyrenesulfonate (average molecular weight: 600,000) (pH was adjusted to 7.4 with NaOH) | 0.9 mg/m² |

Preparation of Coating Solution for Backing Layer

Antihalation Layer

Preparation of Dye Dispersion L

Each 2.5 g of Compound A-9 and dicyclohexyl phthalate, 2,4-diaminophenol were dissolved in 50 cc of ethyl acetate, and this was mixed with 90 g of an aqueous gelatin solution containing 1.5 g of sodium dodecylbenzenesulfonate, 0.18 g of methyl p-hydroxybenzoate at 60° C. and stirred in a homogenizer at high speed. After the completion of high speed stirring, reduced pressure processed using an evaporator at 60° C., and removed 90 wt % of ethyl acetate to thereby obtained Dye Dispersion L having an average grain size of 0.18 μm.

(2) Preparation of Coating Solution

Coating solution 1 was prepared so that the coating weight of each composition became as indicated below.

| | |
|---|---|
| Gelatin | 1.5 g/m² |
| Dextran (molecular weight 39,000) | 0.3 g/m² |
| Phosphoric Acid | 5.2 mg/m² |
| SnowteX C | 0.5 g/m² |
| Ethyl Acrylate/Methacrylic Acid (97/3) Copolymer Latex | 0.5 g/m² |
| Proxel | 4.2 mg/m² |
| Dye Dispersion L | 8.0 g/m² |
| Compound A-21 | 100 mg/m² |

-continued

| | |
|---|---|
| Compound A-22 | 42 mg/m² |
| Compound A-23 | 23 mg/m² |
| Hardening Agent (1,2-Bis(vinylsulfonylacetamido)ethane) | 40 mg/m² |

Compound A-21

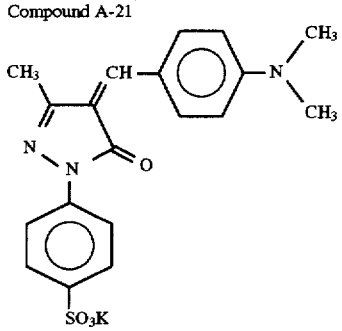

Compound A-22

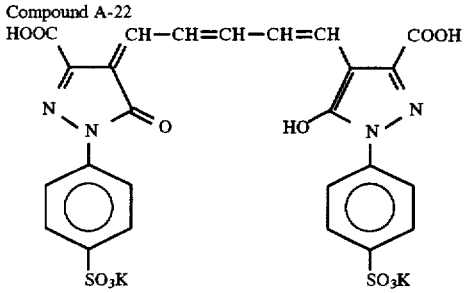

Compound A-23

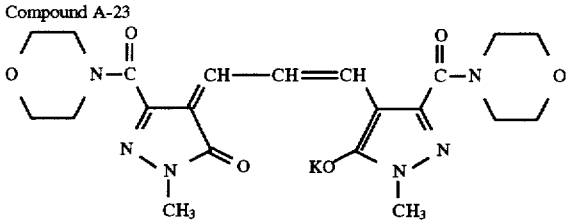

Surface Protective Layer

Coating solution was prepared so that the coating weight of each composition became as indicated below.

| | |
|---|---|
| Gelatin | 1,300 mg/m² |
| Polymethyl Methacrylate | |
| (average grain size: 6.6 μm) | 20 mg/m² |
| (average grain size: 0.75 μm) | 81 mg/m² |
| Compound A-10 | 20 mg/m² |
| Compound A-11 | 40 mg/m² |
| Compound A-13 | 6 mg/m² |
| Compound A-14 | 9 mg/m² |
| Compound A-24 | 1.7 mg/m² |
| Compound A-25 | 13 mg/m² |
| Proxel | 1.3 mg/m² |
| Potassium Polystyrenesulfonate (average molecular weight: 600,000) | 2 mg/m² |
| NaOH | 2.5 mg/m² |
| Compound A-24 | $C_8H_{17}SO_3K$ |
| Compound A-25 | 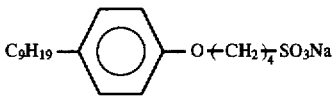 |

The above average grain size is indicated as volume weighted average value.

Preparation of Support

A commercially available polyethylene terephthalate was biaxially stretched in usual manner, heat set was conducted and a film having a thickness of 183 μm was obtained. This support was corona discharged. The corona discharge treatment was carried out using solid state corona processor model 6 KVA available from Pillar Co., Ltd. which can treat the support of 30 cm wide at a rate of 20 m/min. At that time, the treatment of 0.375 KV·A·min/m² was conducted to the support from the reading of the voltage and electric current. The discharge frequency at the treatment time was 9.6 KHz, gap clearance between the electrode and the induction roll was 1.6 mm.

The first subbing layer having the following composition was coated by a wire bar coater so that the coating amount reached 5.1 cc/m², and then dried at 175° C. for 1 minute. Then, the first subbing layer was also coated on the opposite side similarly. The polyethylene terephthalate used contained 0.04 wt % of Compound A-9.

| | |
|---|---|
| Solution of Butadiene-Styrene Copolymer Latex (solid part: 40%, weight ratio of butadiene/styrene = 31/35) | 79 cc |
| 4% Solution of Sodium 2,4-Dichloro-6-hydroxy-s-triazine | 20.5 cc |
| Distilled Water | 900.5 cc |

* In a latex solution, 0.4 wt %, based on the solid part of the latex, of Compound A-18 was contained.

Preparation of Photographic Material

On the above prepared support, the aforementioned back surface antihalation layer and the surface protective layer were coated, then on the opposite side of the support, an emulsion layer and the surface protective layer were coated by a double extrusion method to prepare a photographic material. The coating amount of silver on the emulsion layer side was 2.8 g/m².

Evaluation of Photographic Performance

After the photographic material was exposed from the emulsion layer side for 1 sec by emitting CRT (emitter P-45) for medical multicamera with gradual emission, the material was SP processed using Fuji Film ECPROS-30 processor, developing solution CE-D30, fixing solution CE-F30 and washing temperature at 20° C. The reciprocal of the exposure amount providing a density of Fog+1.0 was taken as the sensitivity, and the Coating Sample No. 9 was taken as 100. The evaluation of natural aging was carried out in the same manner as in Example 1.

TABLE 4

| Coating Sample No. | Sensitivity | Fog | Increase of Fog Rate by Forced Aging |
|---|---|---|---|
| No. 9 | 100 | 0.17 | 2.4 |
| No. 10 | 75 | 0.26 | 9.5 |
| No. 11 | 15 | 0.21 | 3.3 |
| No. 12 | 20 | 0.22 | 3.1 |
| No. 13 | 23 | 0.22 | 4.0 |
| No. 14 | 35 | 0.24 | 5.2 |
| No. 15 | 108 | 0.18 | 2.6 |
| No. 16 | 60 | 0.23 | 7.0 |
| No. 17 | 20 | 0.20 | 3.0 |

As can be seen from Table 4, the emulsion of the present invention showed excellent photographic performance.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having thereon at least one silver halide emulsion layer containing silver halide grains, wherein the silver halide grains have been gold and selenium sensitized, and the partition rate of the gold in the silver halide grain side is not less than 10% and less than 40%.

2. The silver halide photographic material as claimed in claim 1, wherein the silver halide grains are tabular grains having an average aspect ratio of not less than 2.

3. The silver halide photographic material as claimed in claim 1, wherein the silver halide grains are tabular grains having an average aspect ratio of not less than 2, and have an average silver iodide content of not more than 1 mol % based on the total silver amount.

4. A method of producing a silver halide photographic material comprising a support having thereon at least one silver halide emulsion layer, which comprises:

chemically sensitizing silver halide grains for use in said at least one silver halide emulsion layer with a gold sensitizer and a chalcogen sensitizer to have a partition rate of the gold in the silver halide grain side of not less than 50%; and adding to the resulting silver halide grains a compound which forms a complex with gold to have a partition rate of the gold in the silver halide grain side of not less than 10% and less than 40%.

5. The method of producing a silver halide photographic material as claimed in claim 4, wherein said compound which forms a complex with gold is a compound having a stability constant of the complex salt with gold of from 28 to 39.

6. The method of producing a silver halide photographic material as claimed in claim 4, wherein said compound which forms a complex with gold is a sulfite compound.

7. The method of producing a silver halide photographic material as claimed in claim 4, wherein the gold and chalcogen sensitization is gold and selenium sensitization.

8. The method of producing a silver halide photographic material as claimed in claim 4, wherein the silver halide grains are tabular grains having an average aspect ratio of not less than 2.

9. The method of producing a silver halide photographic material as claimed in claim 4, wherein the silver halide grains are tabular grains having an average aspect ratio of not less than 2, and have an average silver iodide content of not more than 1 mol % based on the total silver amount.

10. A silver halide photographic material comprising a support having thereon at least one silver halide emulsion layer containing silver halide grains, wherein the silver halide grains have been gold and chalcogen sensitized, wherein the partition rate of the gold in the silver halide grain side is not less than 10% and less than 40%, and wherein the silver halide grains are tabular grains having an average aspect ratio of not less than 2.

11. The silver halide photographic material as claimed in claim 10, wherein the silver halide grains have an average silver iodide content of not more than 1 mol % based on the total silver amount.

12. The silver halide photographic material as claimed in claim 10, wherein the chalcogen is selenium.

* * * * *